US008607362B2

(12) United States Patent
Zellner

(10) Patent No.: US 8,607,362 B2
(45) Date of Patent: Dec. 17, 2013

(54) DEVICE FOR THE PROTECTION OF COLLARS ON GARMENTS DURING WASHING OR CLEANING

(76) Inventor: Josef Zellner, Kaufbeuren (DE)

( * ) Notice: Subject to any disclaimer, the term of this patent is extended or adjusted under 35 U.S.C. 154(b) by 278 days.

(21) Appl. No.: 13/121,091

(22) PCT Filed: Sep. 28, 2009

(86) PCT No.: PCT/DE2009/050052

§ 371 (c)(1),
(2), (4) Date: Mar. 25, 2011

(87) PCT Pub. No.: WO2010/034306

PCT Pub. Date: Apr. 1, 2010

(65) Prior Publication Data

US 2011/0283434 A1 Nov. 24, 2011

(30) Foreign Application Priority Data

Sep. 27, 2008 (DE) ..... 20 2008 012 916 U

(51) Int. Cl.
*A41D 27/16* (2006.01)

(52) U.S. Cl.
USPC ..... 2/60

(58) Field of Classification Search
USPC ..... 2/60, 129, 255, 256, 175.4, 195.5, 115, 2/116
See application file for complete search history.

(56) References Cited

U.S. PATENT DOCUMENTS

| | | | | |
|---|---|---|---|---|
| 1,484,187 | A * | 2/1924 | O'Neill et al. | 2/60 |
| 2,182,486 | A * | 12/1939 | Broder | 2/139 |
| 2,819,469 | A * | 1/1958 | Lyles | 2/60 |
| 4,953,232 | A | 9/1990 | Gaines et al. | |
| 6,105,166 | A * | 8/2000 | Thomas et al. | 2/60 |
| 7,080,413 | B1 | 7/2006 | Schneider | |
| 2008/0229472 | A1 | 9/2008 | Maggs | |

FOREIGN PATENT DOCUMENTS

| | | |
|---|---|---|
| CH | 195056 | 1/1938 |
| DE | 25 56 628 | 6/1977 |
| GB | 2 401 303 | 11/2004 |

OTHER PUBLICATIONS

International Search Report for PCT/DE2009/050052, dated Feb. 22, 2010 (6 pages).

* cited by examiner

*Primary Examiner* — Tejash Patel
(74) *Attorney, Agent, or Firm* — Hamre, Schumann, Mueller & Larson, P.C.

(57) ABSTRACT

Disclosed is a device for protecting collars on garments during washing or cleaning. Said device comprises two halves which are made of a sheet material and each of which has two edges that taper at the same acute angle (α). The halves are each hinged in such a way that the same can be folded open and closed along one of the two edges. Furthermore, blocking mechanisms are provided which allow the halves to be blocked in the folded state.

17 Claims, 4 Drawing Sheets

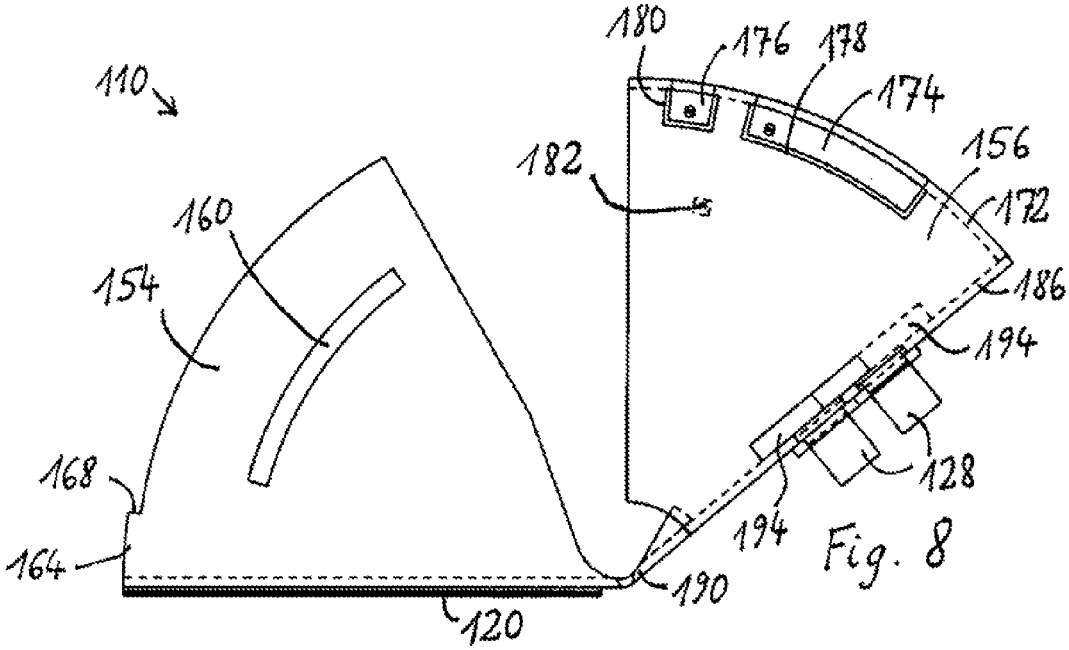
Fig. 8
Fig. 10
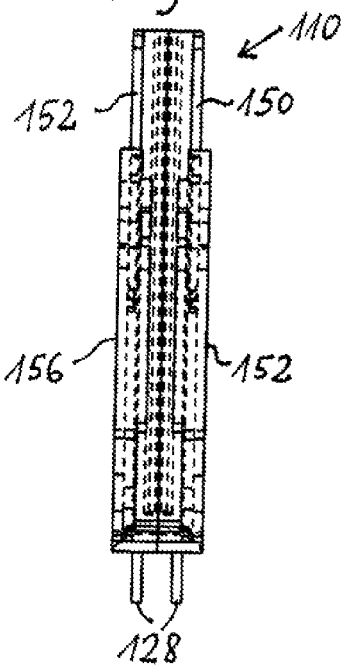
Fig. 9
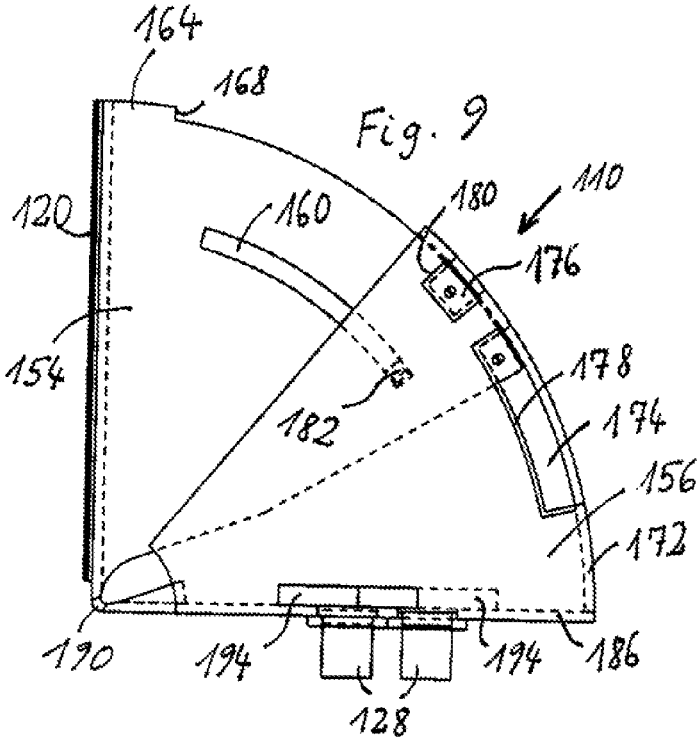

DEVICE FOR THE PROTECTION OF COLLARS ON GARMENTS DURING WASHING OR CLEANING

TECHNICAL FIELD

The present invention relates to a device for the protection of collars on garments during washing or cleaning.

PRIOR ART

Experience has shown that shirts or blouses always suffer the greatest level of wear at the tips of the collar during washing or cleaning. Signs of wear occurring here quickly make the garment look shabby and therefore render it useless.

In order to protect the collar it has already been proposed to button up the relevant garments to be laundered and to wash them "inside out". However, this is not particularly helpful.

DESCRIPTION OF THE INVENTION

Based on this prior art, the object of the invention is to provide a device for the protection of collars on garments during washing or cleaning which is economical, easily applied before washing and easily removed after washing and ensures protection of the tips of the collar during washing or cleaning.

This object is achieved in accordance with the invention by a device which comprises two halves made of a sheet material which each comprise two edges which taper towards one another at the same acute angle, each of the halves being hinged in such a way that they can be folded open and closed along one of the two edges, and locking means being provided with which the halves can be locked when folded closed.

With regard to tolerance of suds, it is particularly preferred for the sheet material to consist of plastics material.

It is further particularly preferred for the sheet material to comprise a large number of openings so that, in spite of application of the device according to the invention, a sufficient washing action is still achieved, even at the tips of the collars.

It is particularly preferred for the openings to be configured as circular cut-outs.

The two halves of the device are preferably interconnected by a living hinge since this is can be produced in a simple and cost-effective manner and is tolerant of suds.

In order still better to prevent removal of the device according to the invention from the tips of the collars during washing, it is preferred for the surfaces, which abut one another when folded closed, of the halves to be provided with raised retaining ridges.

The retaining ridges are preferably sawtooth-shaped in order to further improve the fastening.

In order to simplify production it is recommended to form the retaining ridges in one piece with the sheet material of the halves.

The retaining ridges preferably extend parallel to the bisector of the acute angle between the two edges. An optimal retaining effect is thus obtained.

A plurality of snap-in lugs are preferably provided as locking means and are attached to a bracket which projects towards the other half in the folded closed state and which is arranged on the free edge of the half in such a way that the snap-in lugs engage around, in part, the other half in the folded closed state.

Lastly, it has been found that the collar tips concerned have different acute angles in different garments. These angles are generally between 60 and 90°. It is therefore particularly preferred for the device according to the invention to be developed in such a way that it can be easily adjusted to different angles. The present invention thus proposes that the angle $\alpha$ be variable, in that each half of the device according to the invention is formed of two parts which also consist of a sheet material, are in the shape of sectors of a circle and can each overlap a different region which is also in the shape of a sector of a circle.

In this instance the angle $\alpha$ is preferably between 60 and 90°. This developed device according to the invention can thus be varied within this range.

In order to nevertheless achieve sufficient stability of the device it is particularly preferred, in each case, for one part of the halves to comprise brackets on its radial outer edge which engage around the respective other part of the respective half from the outside in the assembled state.

In order to nevertheless manufacture the corresponding parts easily in a plastics injection moulding process, it is preferred for the parts with the brackets to comprise corresponding recesses in the region of the brackets in the opposing material. The undercuts which are extremely difficult to produce in the injection moulding process are thus avoided.

It is particularly preferred, in each case, for one part of the halves to comprise a slit which is in the shape of a sector of a circle and for the respective other part of the halves to be provided with a lug which is arranged in such a way that it engages in the slit in the assembled state. Stops are thus provided which define the range of adjustment of the device and thus increase stability.

In order to define the stop zone it may also be provided for the respective other part to comprise an outwardly protruding step on its outer periphery, which step acts as a stop in the assembled state for the part provided with the brackets.

The device according to the invention is preferably produced as an injection-moulded part made of plastics material. This provides optimal, cost-effective mass production and simultaneously the desired chemical and physical properties, since the device according to the invention has to be resistant to suds and heat.

Manufacture by injection moulding is a particularly advantageous manufacturing option since the parts of the halves are only interconnected by a thin strip of plastics material before assembly.

BRIEF DESCRIPTION OF THE DRAWINGS

The present invention will be described hereinafter in greater detail with reference to the embodiment illustrated in the drawings, in which:

FIG. 8 shows the device of FIG. 7 once the two halves have been folded closed along the living hinge;

FIG. 9 shows the device of FIG. 8 once the two respective parts of the halves have been plugged into one another;

FIG. 10 shows the device of FIG. 9, viewed in the radial direction; and

PREFERRED EMBODIMENT OF THE INVENTION

Figure 1:
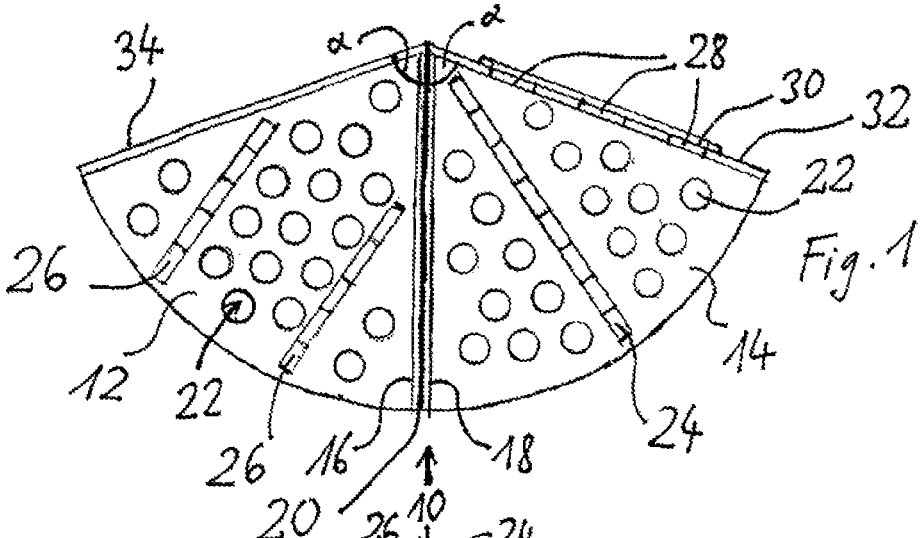
FIG. 1 shows a device according to the invention in the folded open state.

The device 10 shown in FIG. 1 for the protection of collars on garments during washing or cleaning comprises two halves 12, 14 made of a sheet material. The halves 12, 14 are each in the shape of a sector of a circle which comprises an angle α of 60 to 90°, preferably 70°, towards the centre point of the circle. Each half 12, 14 thus comprises two radially extending edges 16, 18; 32, 34.

The two halves 12, 14 are hinged together at their adjacent, radially extending edges 16, 18 by a living hinge 20 so they can be folded. The folded open state can be seen in FIG. 1, the sides of the halves which face the collar in the folded closed state being shown.

The two halves comprise circular openings or cut-outs 22 which, as "washing pores", allow the suds to reach the enclosed part of the collar.

Figure 2:
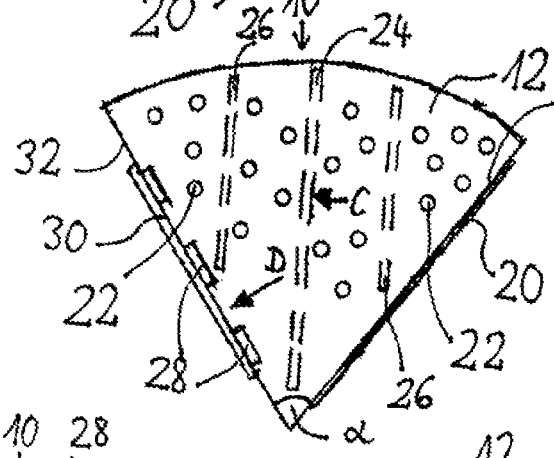
FIG. 2 shows a device according to the invention with a different arrangement of the washing pores in the closed state.

In this instance the size and arrangement of these washing pores 22 can be varied, as also shown by the different embodiments illustrated in FIGS. 1 and 2.

The surfaces shown in FIG. 1 which face the collar in the closed state are further provided with retaining ridges 24, 26. The retaining ridge 24 extends along the bisector of the acute angle α of the half 14 over practically the entire radial extension of this half 14.

Two shorter retaining ridges 26 are arranged on the other half 12 and extend parallel to the bisector of the acute angle α of the half 12, but outwardly offset from the bisector. The two retaining ridges 26 are shorter in length than the retaining ridge 24.

Figure 6:
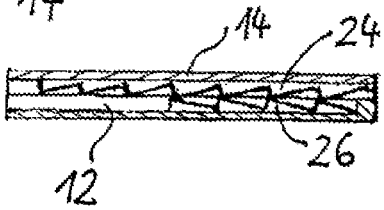
FIG. 6 is a sectional view which illustrates the cooperation of the sawtooth retaining ridges.

The retaining ridges 24, 26 are preferably produced in one piece with the material of the halves 12, 14 and have a sawtooth progression, as is illustrated in greater detail in FIG. 6.

In order to hold the device 10 according to the invention in the folded closed state and simultaneously on the respective tips of a collar, three snap-in lugs 28 are arranged as locking means on a bracket 30 which protrudes towards the other half 12 in the folded closed state. The bracket 30 is attached to the outer, free, radially extending edge 32 of the half 14 in such a way that, in the folded closed state, it protrudes perpendicularly towards the other half 12 and beyond it.

FIG. 2 shows an embodiment of the invention comprising slightly modified washing pores 22 in the closed state. The snap-in lugs 28 can thus be seen more clearly, whereas the retaining ridges 24, 26, which are not visible in this state, are illustrated merely by dashed lines. Incidentally, like reference numerals are again used to denote like components.

In the closed state illustrated in FIG. 2, the device 10 according to the invention normally engages around a tip of a collar of a garment in order to protect it during the washing or cleaning process against damage and/or mechanical wear.

The shape of the folded closed device 10 does not necessarily have to correspond to that shown in FIG. 2. Instead of the sector of a circle shape illustrated in FIGS. 1 and 2, the device 10 according to the invention may also be triangular or rhomboidal.

Figure 3:
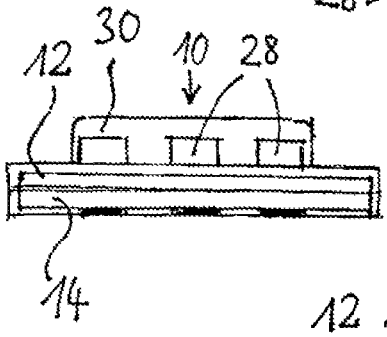
FIG. 3 shows the arrangement of FIG. 2, viewed from the free edge.

FIG. 3 shows the closed device 10 of FIG. 2 from the viewing direction denoted in FIG. 2 by D. In this instance the configuration of the bracket 30 and of the snap-in lugs 28 can be seen more clearly. The bracket 30 extends over a large part of the length of the edge 32 of the half 14 and has a rounded rectangular shape. It carries the snap-in lugs 28, which engage around the other half 12 in the closed state and thus hold the device 10 closed.

Figure 4:
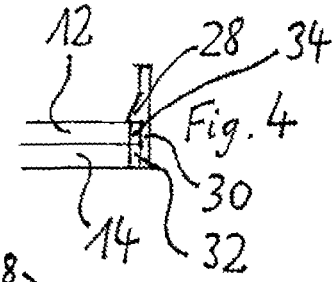
FIG. 4 shows the detail of the snap-in lugs.

The action of the snap-in lugs 28 can be seen more clearly still in FIG. 4. This figure shows a detail of the closed device 10 according to FIG. 2 along the radial edge 32 viewed towards the centre point of the circle. In this case it can be seen particularly clearly how the snap-in lugs 28 on the bracket 30 engage around and hold the half 12.

Figure 5:
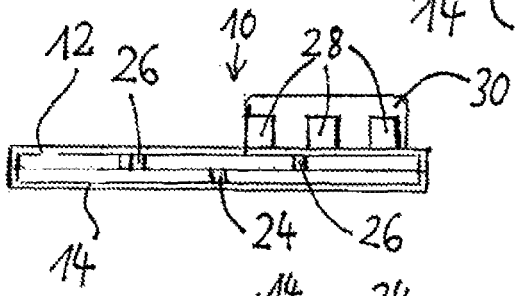
FIG. 5 shows the arrangement of FIG. 2, viewed from the collar.

FIG. 5 shows the folded closed device 10 of FIG. 2, viewed towards the centre point from the circular edge of the sectors. The arrangement of the retaining ridges 24, 26 can be seen clearly as well as the snap-in lugs 28 on the bracket 30 which can be seen diagonally.

FIG. 6 shows a sectional view parallel to the bisector of the angle α in the viewing direction denoted in FIG. 2 by C. In this instance the sawtooth progression of the retaining ridges 24, 26 can be seen very clearly. The sawtooth structure of the retaining ridges 24, 26 is arranged in such a way that the steeper or almost vertical side of the saw teeth points towards the acute angle α, whereas the planar side of the saw teeth points radially outwardly. As a result of this sawtooth configuration, the device 10 according to the invention holds on better still to the tips of the corresponding collars in the closed state.

The device 10 according to the invention is used as follows: in the idle state the device 10 according to the invention is folded open, as shown in FIG. 1. In order to now protect the tips of a collar, for example of a shirt or blouse, the device 10 according to the invention is folded closed around the tips of the shirt collar in such a way that the pointed end of the collar is arranged between the two halves 12, 14 of the device 10 and the snap-in lugs 28 engage around the half 12. The device 10 according to the invention is thus held in place, by the retaining ridges 24, 26, on the pointed end of the collar in such a way that it cannot be thrown off, even during normal washing movements.

Nevertheless, a sufficient inlet and outlet of suds though the openings 22 is possible during the washing procedure, in such a way that even the protected tips of the collars are sufficiently subjected to the washing process.

After washing the device 10 can be easily opened again by pressing the bracket 30 outwards (away from the device 10) and removed from the tip of the protected collar.

The device 10 according to the invention thus prevents the high level of wear of the tips of collars of garments during the washing process.

EMBODIMENT(S) OF THE INVENTION

Figure 7:
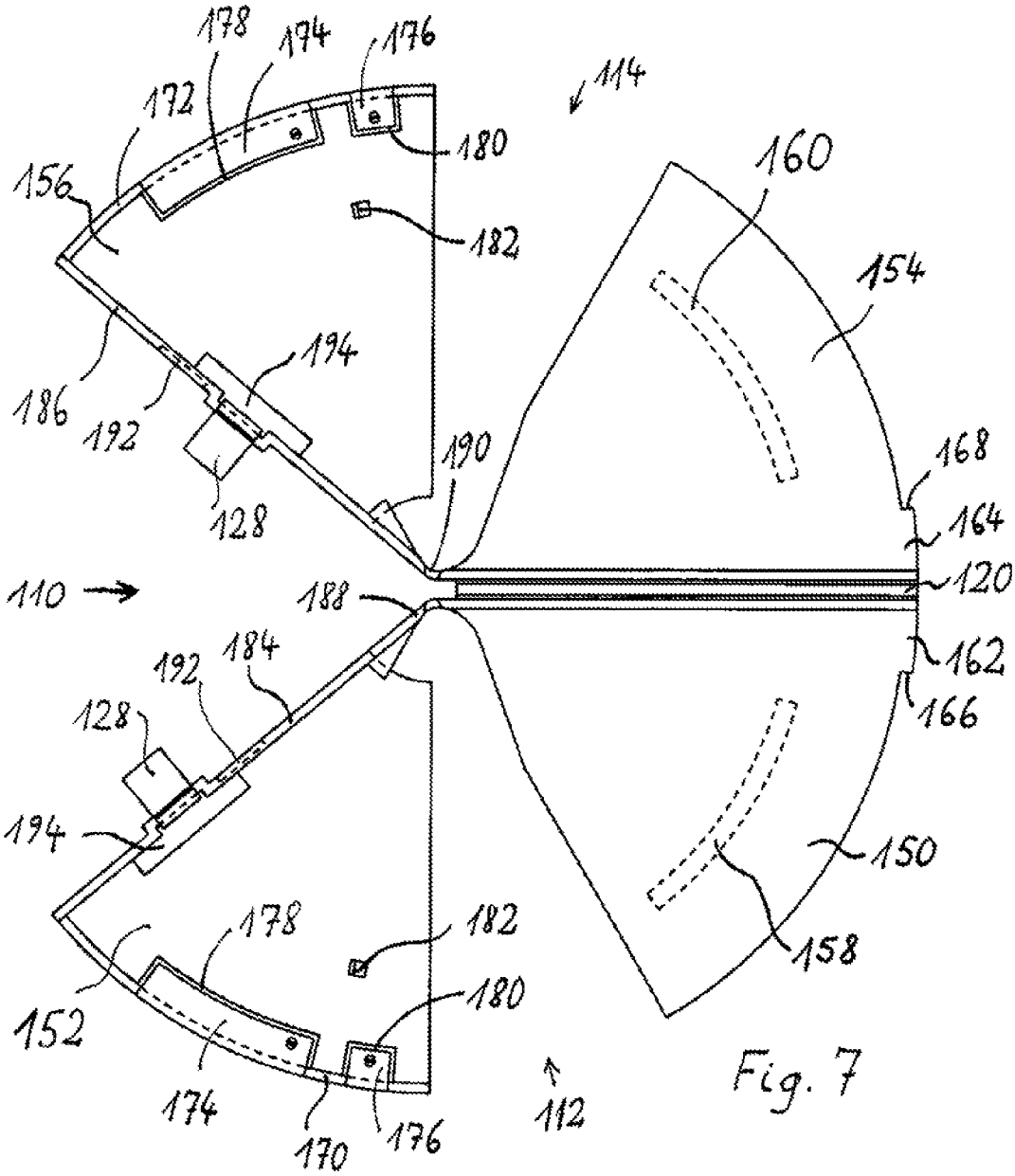
FIG. 7 shows a further, adjustable device according to the invention before assembly (how it emerges from the injection mould)

FIG. 7 shows a further embodiment of the present invention, in which the angle α is variable. In this case also the adjustable device 110 consists of two halves 112, 114 made of a sheet material. In this case also these two halves are hinged together along a radially extending edge by a living hinge 120 so they can be folded.

The adjustability, i.e. the adaptability, of this further embodiment of the present invention to different angles of the collars is provided in that each half 112, 114 is formed in each case of two parts 150, 152 and 154, 156 which are preferably mirror symmetrical.

The two parts 150, 154 meet one another at the living hinge 120 and are completely mirror symmetrical. They are substantially shaped as circular sectors with an angle of approximately 60°. The two parts preferably have a narrow, long slit 158, 160 which is also in the shape of a portion of a circle. The radial outer edge of the two parts 150, 154 follows the line of a circle and in each case comprises an extension 162, 164, at approximately 10 degrees from the living hinge 120, which extension protrudes radially outwardly via a radially, i.e. perpendicularly, extending step 166, 168 and extends as far as the living hinge 120.

The respective other parts 152, 156 of the two halves 112, 114 are also substantially circular with an angle of approximately 45°. These two parts 152, 156 are also substantially, but not completely, mirror symmetrical. The differences are formed by the two snap-in devices 128 for closing the device 110 according to the invention and these will be explained in greater detail hereinafter.

The parts 152, 156 have a greater radial extension outwardly than the parts 150, 154 and have, at their radially outer edge, an edge strip 170, 172 which, in this case, is extended towards the observer and extends perpendicular to the sector face. This edge strip preferably comprises one or more brackets 174, 176 which in turn extend radially inwardly perpendicular to the strip 170, 172.

The underlying sheet material of the sector faces, viewed by the observer, is recessed in the region of these strips 174, 176 and thus comprises a corresponding, yet in each case somewhat larger opening 178, 180. These recesses 178, 180 are provided in order to considerably facilitate the manufacture of the adjustable device 110 according to the invention in the injection moulding process, since undercuts can thus be avoided.

Furthermore, lugs 182 are provided in the parts 152, 156 with the same radial spacing as that comprised by the slits 158, 160 in the parts 150, 154, which lugs in this instance each point towards the observer. For the purpose of simpler manufacture, these lugs 182 are folded perpendicularly upwardly from the face towards the observer in such a way that, next to the lugs 182, a small opening is formed in the face. In the radial direction the lugs 182 comprise an extension which is somewhat shorter than the radial width of the slits 158, 160.

The radially extending edge of the parts 152, 156 which is turned away from the respective other part 150, 154 is also provided with a strip 184, 186 protruding perpendicularly towards the observer. This strip 184, 186 transitions in each case into a strip of plastics material which connects the parts 150, 152 and 154, 156 respectively. The strips 184, 186 then extend further along the two sides of the living hinge 120, again radially outwardly as far as the radial outer end of the extensions 162, 164.

A snap-in device 128 is still provided in each case in the progression of the strips 184, 186 and is attached in each case to an elevation of the respective strip 184, 186 extending toward the observer. Next to the snap-in device 128 in each case, a corresponding catch 192 for the respective other bracket 128 is provided on the side turned away from the observer. For this reason the configuration of the parts 152, 156, in this instance also, is not quite mirror symmetrical. In order to ensure smooth cooperation between the bracket 128 and the catch 192, they must swap places about the line of mirror symmetry in each case. If the bracket 128, as shown in this instance, is thus arranged on the part 152 radially outside the recess 192, the bracket 128 must be accordingly arranged inwardly on the other part 156.

In order to improve the resilience of the snap-in closure, the bracket 128 is surrounded in each case by an elongate, rectangular recess 194 in the sheet, sector-shaped material of the respective part 152, 156. In this way not only can the bracket 128 be somewhat resilient, but also the respective strip 184, 186 since it is not connected directly to the sector-shaped face of the respective part.

In FIG. 7 and in the following figures, no openings for the penetration of suds are shown, as in FIGS. 1 and 2. This is merely for the sake of clarity of the drawings. Corresponding openings for the suds can, of course, also be provided in the embodiment according to FIG. 7 et seq.

FIG. 7 shows the adjustable device 110 according to the invention as it emerges from the injection mould.

FIG. 8 shows the next step of assembly of the device 110 according to the invention. In this case the two halves 112, 114 are folded closed towards one another along the living hinge 120 until the respective brackets 128 of the parts 152, 156 can snap into the respective opposing recess 192.

The parts 150, 154 and 152, 156 which have been folded together thus now form planar hollow bodies, the respective halves forming the lower and upper surfaces, whilst the living hinge and the adjacent strips as well as the strips 184, 186 form the lateral delimitations, i.e. a radially extending side wall of the respective hollow body. The opposing sides of the hollow body are open.

The parts 154 and 156 and 150 and 152 are now plugged into one another in order to adapt to the respective angle of the collar, as shown in FIG. 9. The respective lugs 182 engage in the slit 158, 160, whilst the parts 150, 154 are inserted between the respective brackets 176, 174 and the sector-shaped face of the respective part 152, 156. FIG. 9 shows the state in which the maximum angle $\alpha$ (in this case 90°) is formed. The angle can be reduced accordingly by pushing together the hollow bodies formed by the parts 150, 154 and 152, 156, as shown in FIG. 11.

FIG. 10 shows the device 110 according to FIG. 9, viewed radially outwardly along the edge with the locking means 128.

Figure 11:
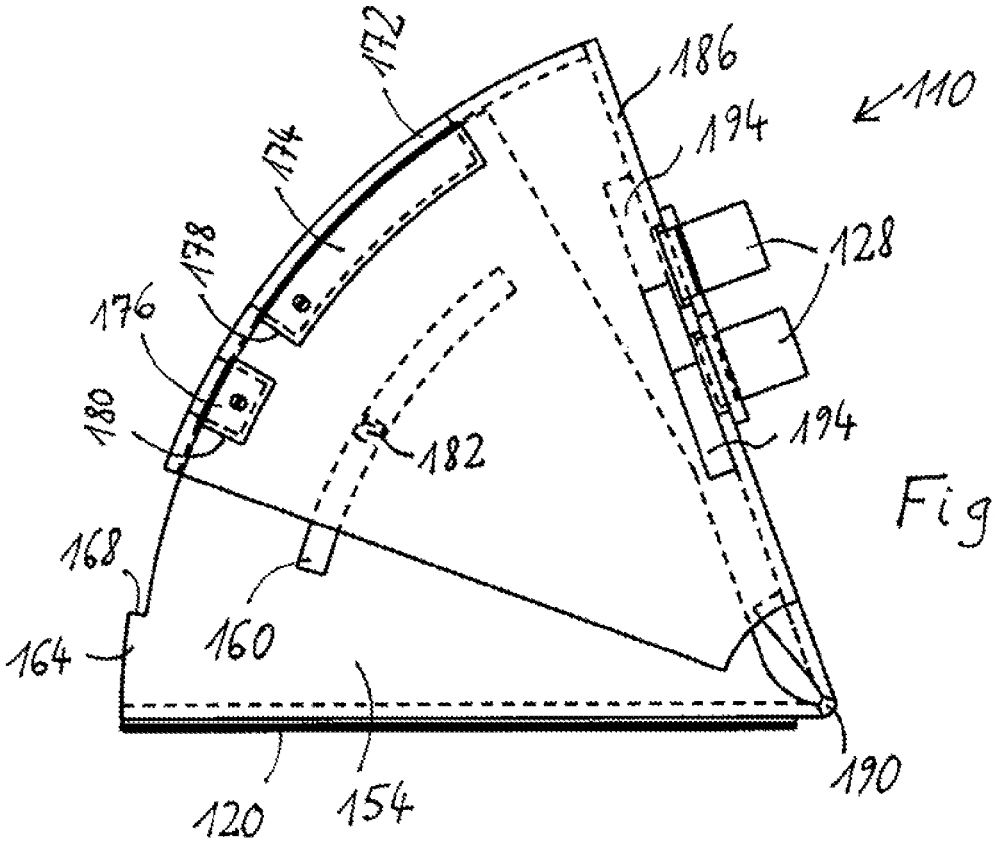
FIG. 11 shows the device of FIG. 9 set to a more acute angle.

FIG. 11 shows the device 110 according to FIG. 9 adjusted to a more acute angle $\alpha$. The respective parts 150, 152 and 154, 156 overlap a greater sector-shaped region, the lugs 182 are arranged in the vicinity of the centre of the slits 158, 160, and the angle $\alpha$ is now approximately 75°.

The embodiment shown in accordance with FIGS. 7 to 11 can thus be adapted optimally to different collar shapes and is simultaneously very easy to produce using injection moulding technology and is also easy to assemble.

The invention claimed is:

1. Device for the protection of collars on garments during washing or cleaning, wherein the device comprises two halves made of a sheet material which each comprise two edges which taper toward one another at the same acute angle ($\alpha$), the halves being hinged in such a way that they can be folded open and closed along one of the two edges, and locking means being provided with which the halves can be locked when folded, wherein the sheet material of the halves consists of plastics material, and comprises a large number of openings.

2. Device according to claim 1, wherein the openings are formed as circular cut-outs.

3. Device according to claim 1, wherein the halves are interconnected by a living hinge.

4. Device according to claim 1, wherein the surfaces of the halves which lie against one another in the folded closed state are provided with raised retaining ridges.

5. Device according to claim 4 wherein, the retaining ridges are sawtooth-shaped.

6. Device according to claim 4, wherein the retaining ridges are formed in one piece with the sheet material of the halves.

7. Device according to claim 4, wherein the retaining ridges extend parallel to the bisector of the acute angle ($\alpha$).

8. Device according to claim 1, wherein a plurality of snap-in lugs are provided, as locking means, on a bracket which projects towards the other half in the folded closed state and which is arranged on the free edge of the half, in such a way that the snap-in lugs engage around, in part, the other half in the folded closed state.

9. Device according to claim 8, wherein the locking means are formed in one piece with the sheet material of the half.

10. Device for the protection of collars on garments during washing or cleaning, wherein the device comprises two halves made of a sheet material which each comprise two edges which taper toward one another at the same acute angle ($\alpha$), the halves being hinged in such a way that they can be folded open and closed along one of the two edges, and locking means being provided with which the halves can be locked when folded, wherein the angle ($\alpha$) is variable, in that each half is formed of two parts which also consist of a sheet material, are in the shape of sectors of a circle and can each overlap a different region which is also in the shape of a sector.

11. Device according to claim 10, wherein the angle ($\alpha$) can vary between 60 and 90°.

12. Device according to claim 10, wherein a part of the halves comprises brackets on its radial outer edge which engage around the respective other part from the outside in the assembled state.

13. Device according to claim 12, wherein the parts with the brackets comprise corresponding recesses in the region of the brackets in the opposing material.

14. Device according to claim 10, wherein a part of the halves comprises a slit which is in the shape of a sector of a circle, and the respective other part of the halves is provided with a lug which is arranged in such a way that it engages in the respective slit in the assembled state.

15. Device according to claim 12, wherein the respective other part comprises an outwardly protruding step on its outer periphery, which step acts as a stop in the assembled state for the part provided with the brackets.

16. Device according to claim 10, wherein it is produced as an injection-moulded part made of plastics material.

17. Device according to claim 16, wherein the parts of the halves are only interconnected by a thin strip of plastics material before assembly.

* * * * *